US005085235A

United States Patent [19]

Rossmo

[11] Patent Number: 5,085,235

[45] Date of Patent: Feb. 4, 1992

[54] REFLEXOLOGY NAIL STIMULATOR

[76] Inventor: William Rossmo, 158 Mt. Allison Crescent, Saskatoon, Saskatchewan, Canada, S7H 4A5

[21] Appl. No.: 392,080

[22] Filed: Aug. 10, 1989

[30] Foreign Application Priority Data

Aug. 12, 1988 [CA] Canada ..... 574677

[51] Int. Cl.[5] ..... A45D 29/05

[52] U.S. Cl. ..... 132/75.8; 132/73.6; 51/102

[58] Field of Search ..... 132/73, 73.5, 73.6, 132/75.6, 75.8, 76.4; 51/72 R, 102; 128/56

[56] References Cited

U.S. PATENT DOCUMENTS

| | | | |
|---|---|---|---|
| 1,207,755 | 12/1916 | Holec | 132/73.6 |
| 1,602,184 | 10/1926 | Whitehead | 132/73.6 |
| 1,657,768 | 1/1928 | Sandford | 132/73.6 |
| 2,250,975 | 7/1941 | Sussman | 132/73.6 |
| 2,663,293 | 12/1953 | Elliott | 128/56 |
| 2,689,435 | 9/1954 | Griffin | 51/72 R |
| 3,216,034 | 11/1965 | Johnson | 132/73.6 |
| 3,255,766 | 6/1966 | Hartwell et al. | 132/73.6 |
| 3,563,252 | 2/1971 | Spohr et al. | 132/73.6 |
| 3,730,191 | 5/1973 | Doornbos | 132/73.6 |
| 3,754,556 | 8/1973 | Watkins | 132/73.6 |
| 3,916,920 | 11/1975 | Tsukamoto | 132/73 |
| 4,366,828 | 1/1983 | Hokama | 132/75.6 |
| 4,478,232 | 10/1984 | Yasuda | 132/75.6 |
| 4,800,606 | 1/1989 | Kolesky | 132/73.6 |

FOREIGN PATENT DOCUMENTS

| | | | |
|---|---|---|---|
| 0526428 | 5/1955 | Italy | 132/73.6 |

*Primary Examiner*—John J. Wilson
*Assistant Examiner*—Frank A. LaViola
*Attorney, Agent, or Firm*—Jacobson and Johnson

[57] ABSTRACT

Shown is a device to apply friction and/or vibration to the fingernails to simulate the action of placing the fignernails of one hand against the fingernails of the other hand and buffing them together in a relatively fast up and down motion. It includes four wheels or belts having spaced apart raised portions or bumps around the periphery thereof. The drive is such that the speed of rotation of the peripheries is substantially equal although the position of the individual wheels or belts is such that they are positioned to engage the fingernails of the hand because the fingers are of different lengths. Alternatively, vertically operated vibration or methods may be utilized to stimulate the nails, said vertical vibration being either mechanical or electrical.

20 Claims, 10 Drawing Sheets

REFLEXOLOGY NAIL STIMULATOR

BACKGROUND OF THE INVENTION

This invention relates to new and useful improvements in devices and methods for stimulation of the fingernails which not only improves the blood flow beneath the nails but is also believed to assist in the stimulation of other parts of the body in the art of Reflexology.

Conventionally, this stimulation is generated by curling the fingers of each hand so that the finger-nails of one hand contact the fingernails of the other whereupon the hands are reciprocated rapidly in a vertical relationship with the nails of one hand contacting the nails of the other.

However this is sometimes time consuming and tiring so that the present device undertakes this action thereby simulating the conventional method of nail stimulation.

This stimulation procedure may then be undertaken in the comfort of a chair without effort and adjustable stands have been provided to support the device at convenient locations depending upon circumstances.

PRIOR ART

U.S. Pat. No. 1,207,755, Dec. 12, 1916, A.V. Hollec. This shows a rotating nail polishing machine with smooth nail engaging grooves in a roller.

U.S. Pat. No. 3,255,766, June 14, 1966, D. S. Hartwell et al. This shows a manicuring device which includes a power driven flat sanding disk or an emery drum for smoothing rough places on a persons skin or nails.

U.S. Pat. No. 3,563,252, Feb. 16, 1971, Sunbeam Corporation. This shows a manicuring device which includes a power driven nail shaper, cuticle pusher, cuticle brush, buffer and callous remover.

U.S. Pat. No. 3,730,191, May 1, 1973, William A. Doornbos. This shows a finger mask and apparatus for polishing fingernails which utilizes a mask to mask the skin portion of the finger tip while exposing the fingernail to be polished and which is suitable for use in combination with an aerosol can of nail polish so that the nail polish may be applied in a relatively rapid manner.

U.S. Pat. No. 3,754,556, Aug. 28, 1973, Jasper J. Watkins. This shows an automatic nail file with a fingernail receiving slot in the casing with flexible manicuring or nail filing means moveable within the casing to contact the nail.

One aspect of the invention is to provide a stimulating device for fingernails comprising in a combination a base, finger supporting means on said base, individual fingernail contacting stimulator means for each finger, mounted for intermittent contact with the fingernails of the fingers supported by said supporting means and a source of power for said fingernail contacting stimulator means.

Another aspect of the invention is to provide a method of stimulation for fingernails consisting of supporting the fingers whereby the fingernails are engaged with a relatively fast moving resilient surface having projections formed in substantially equidistantly spaced apart relationship upon the said resilient surface.

A further advantage of the invention is to provide a device which is simple in construction, economical in manufacture and otherwise well suited to the purpose of which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIGS. 5A, B and C show various types of support stands usable upon chairs and the like.

In the drawings like characters of reference indicate corresponding parts in the different FIGURES.

DETAILED DESCRIPTION

Proceeding therefore to describe the invention in detail, it should be noted first that all of the embodiments shown refer to an embodiment usable with the left hand of the operator It is to be understood of course that a oorrespondinq unit with the finger locations positioned differently, is provided for the right hand so that one or both can be used as desired.

Figure 1:
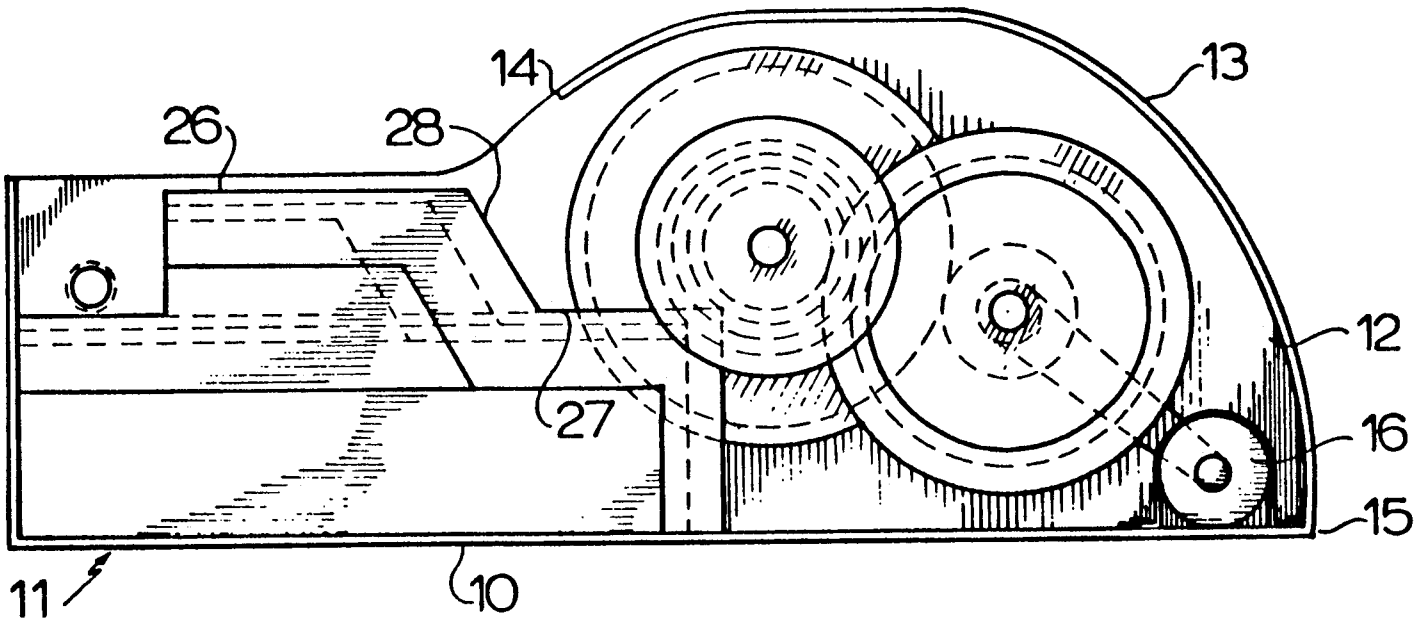
FIG. 1 is a side elevation of the preferred embodiment of the invention with one side plate removed for clarity.
Figure 2:
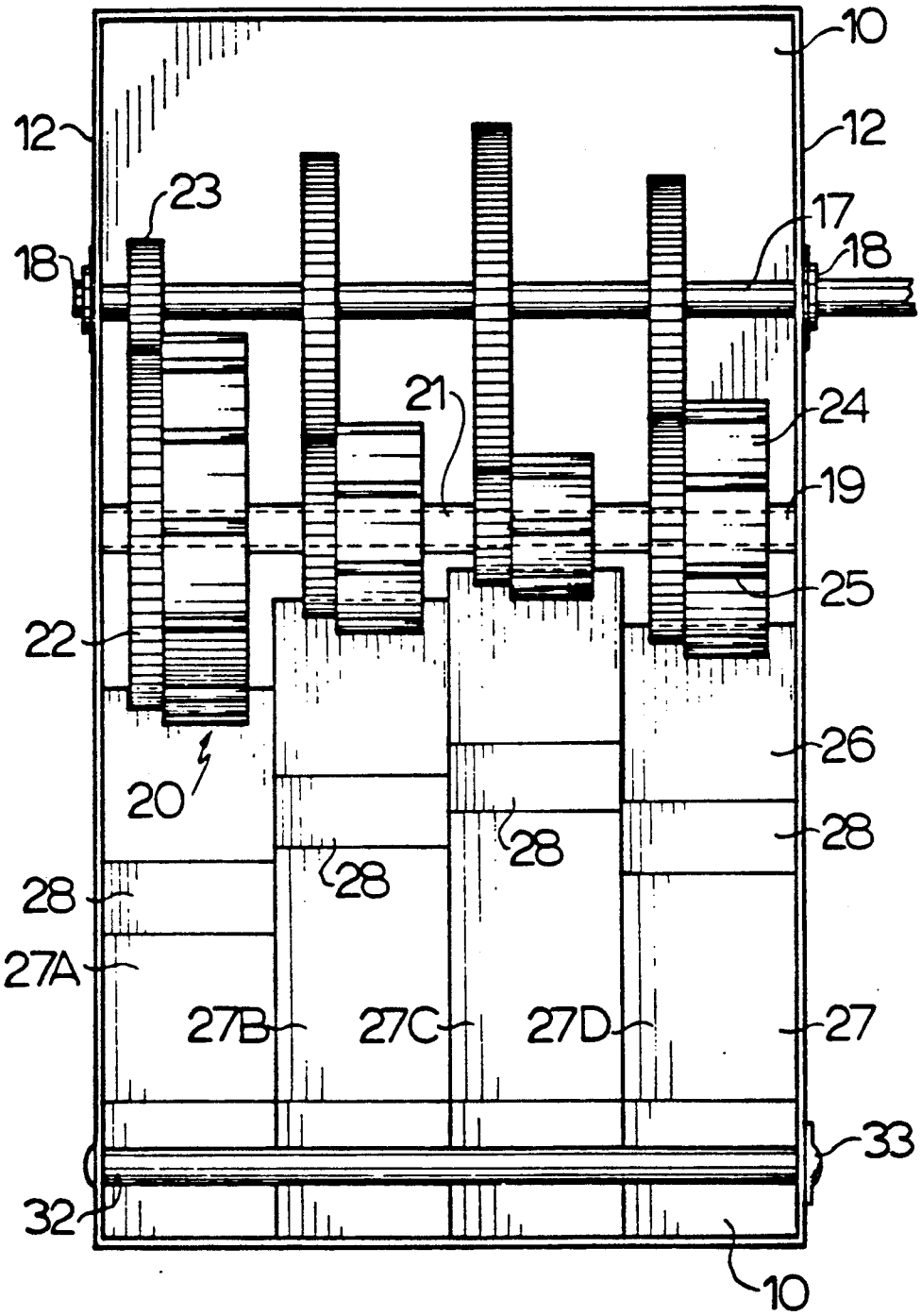
FIG. 2 is a partially schematic top plan view with the cover removed for clarity.
Figure 3A:
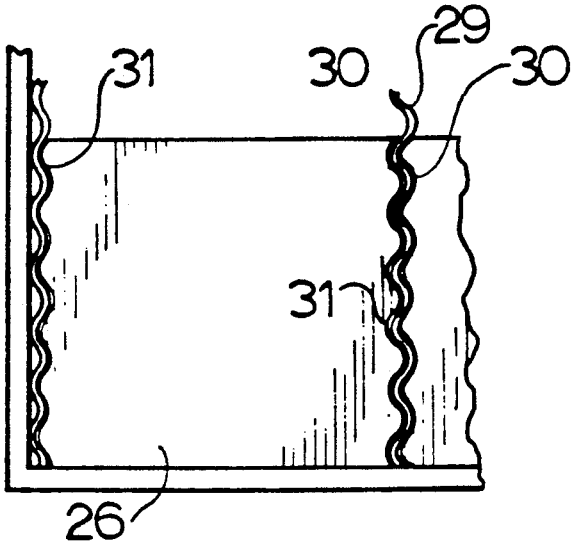
FIG. 3A is a fragmentary partially schematic end view showing an adjustment means of the heightening blocks.
Figure 3:
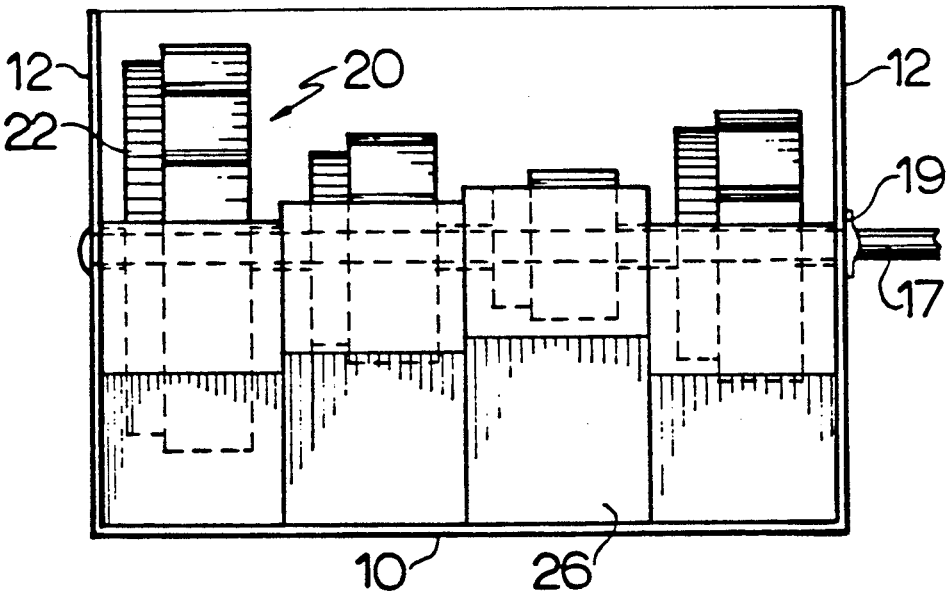
FIG. 3 is an end elevation with the cover removed.

Describing first the embodiment shown in FIGS. 1, 2 and 3, it consists of a substantially rectangular base 10 of a casing collectively designated 11 having side panels 12 and a cover panel 13 which extends from approximately location 14 over and downwardly to the rear end 15 of the base panel 10.

In all embodiments a source of power is provided which may either be external or internal as is shown schematically by reference character 16 in FIG. 1.

This source of power is operatively connected to a common drive shaft 17 supported for rotation transversely within bearings 18 situated on the side panels 12 of the casing and towards the rear thereof.

A fixed support shaft 19 also extends between the side panels 12 forwardly of the drive shaft 17 and in this embodiment, four fingernail contacting stimulator wheels are journalled for free rotation thereon each provided with locating spacers 21, it being understood that the individual stimulator wheels are mounted for separate free rotation upon the support shaft or spindle 19.

A gear 22 is secured to the side of each of the wheels 20 coaxially therewith and each gear engages a corresponding gear 23 secured to drive shaft 17 and rotatable thereby.

Figure 1A:
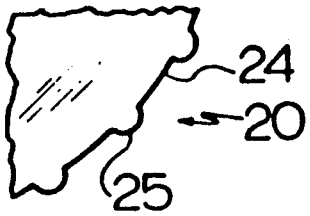
FIG. 1A, is an enlarged side elevation of one of the fingernail contacting stimulator wheels of FIGS. 1, 2 and 3.

It will be noted from FIG. 2 that each stimulator wheel 20 is of a different diameter, the purpose of which will hereinafter become apparent and that the pairs of gears driving same are sized or dimensioned in order to produce approximately the same peripheral speed to the surface of the wheels 20. These wheels 20, in this embodiment, are provided with a resilient external cover 24 having transversely situated raised portions 25 equidistantly spaced around the periphery thereof and shown in detail in FIG. 1A.

Not illustrated are the necessary switches for the source of power and, if desired, a conventional speed control therefore.

The fingers of the user are supported upon finger beds 26 which in turn are mounted upon heightening blocks 27.

Each individual bed 26 includes a raised portion 27 over which the rear ends of the fingers may rest with the fingers themselves being supported upon the front sloping faces 28 and the fingertips upon the front end of the heightening blocks 27 and it will be of course appreciated that each finger when curled downwardly with the nails facing the stimulator wheels 20, have to be of a different height to support the ends of the fingers comfortably because the fingers are of differing lengths.

In FIG. 1, the finger support or bed 27A is for the little finger, 27B is for the ring finger, 27C is for the middle finger, and 27D for the index finger. This positioning is shown clearly in FIG. 2 and is of course the reason for the different sized stimulator wheels 20 so that approximately the same distance is provided between the base of the slopes 28 and the front peripheries of the wheels 20.

Means may be provided to adjust the height of the heightening blocks to enable the users fingers to be supported comfortably and one method is shown in FIG. 3A. Vertically situated stationary dividers 29 extend upwardly from the base and are provided with horizontally situated corrugations 30 upon a side thereof.

The sides 31 of the heightening blocks 27 are also horizontally corrugated to match the corrugations 30 so that by sliding the blocks out they can then be repositioned at any desired height by engaging the corrugations of the blocks with the dividers. Other methods may of course be used.

The beds may be held in position by means of a transverse rod 32 spanning between the side walls 12 and held in place by means of a spring end clip 33.

In operation, the beds and heightening blocks 27 and 26 are adjusted to suit the user whereupon the fingers may be positioned and the nails offered up to the individual rotating stimulator wheels 20 with the projections 25 providing the vibrating buffing action normally provided by reciprocating the fingernails of one hand vertically with relation to those of the other hand as hereinbefore described.

Figure 4:
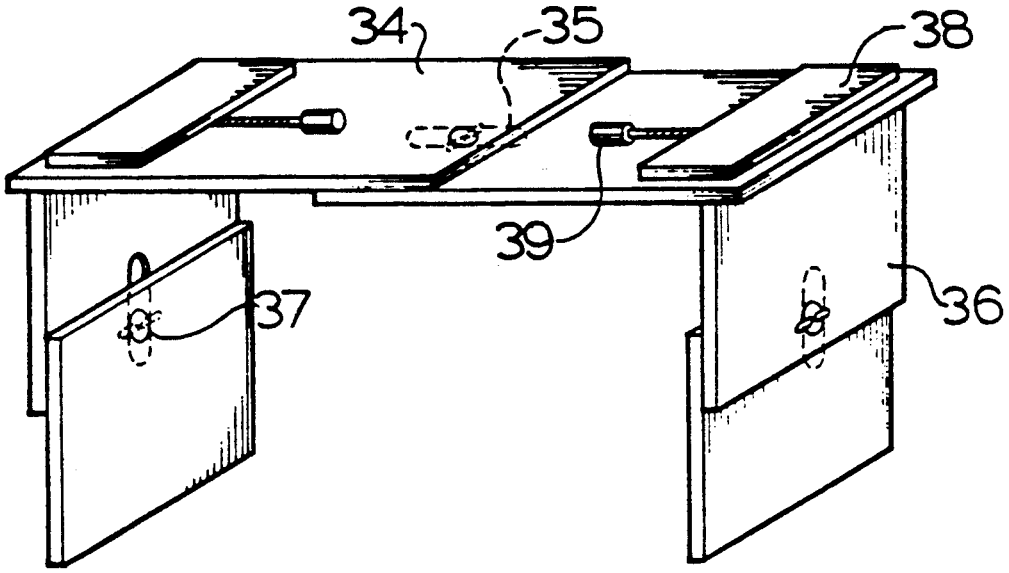
FIG. 4 is an isometric view of an adjustable stand for the device.

FIG. 4 shows a convenient table having a planar top 34 which is adjustable lengthwise by means of the overlapping sliding clamp assembly 35 and supported upon leg units 36 which are also adjustable vertically in a similar manner as indicated by reference character 37. Other methods of vertical and horizontal adjustment may of course be used.

The units or devices collectively designated 11 may be placed and detachably secured upon plates 38 adjacent each end of the horizontal table top 34 and, if desired, may be adjusted relative to the ends of the table top by means of conventional lateral screw adjustments 39. Once set up it is not normally necessary to make further adjustments.

Figure 5A:
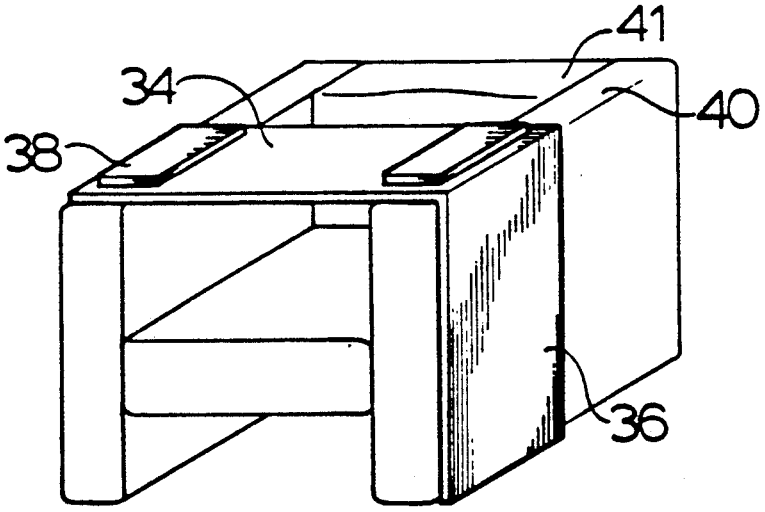
Figure 5B:
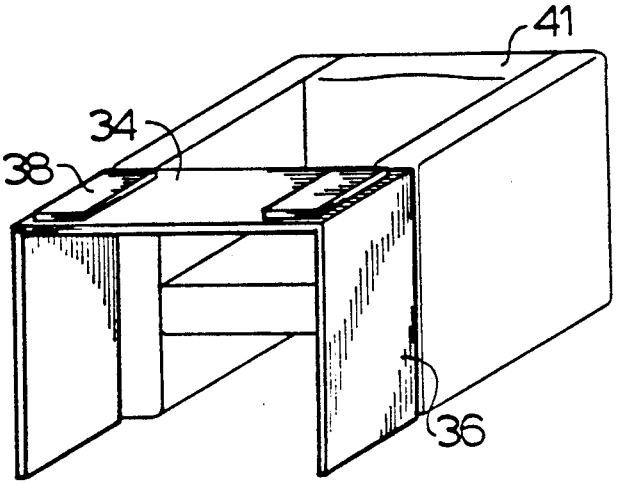
Figure 5C:
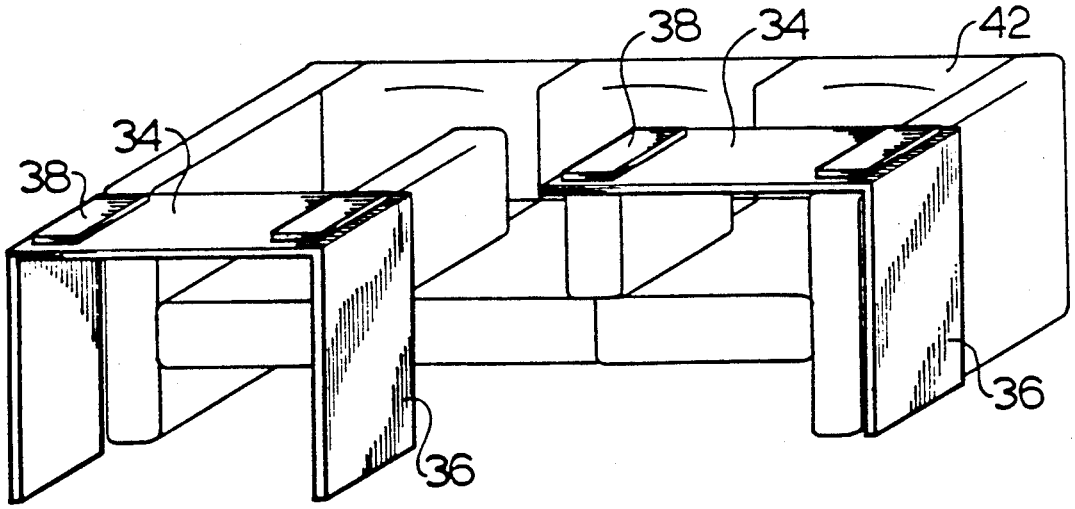

FIGS. 5A, 5B and 5C show similar type tables having one or two legs and suitable for placement across the upper sides of the front of the arms 40 of an armchair 41 or just forwardly thereof as shown in FIG. 5B utilizing the table of FIG. 4 and FIG. 5C showing either of the embodiments of the table of 5A and 5B utilized with a sofa or chesterfield 42 as shown in 5C.

Figure 6:
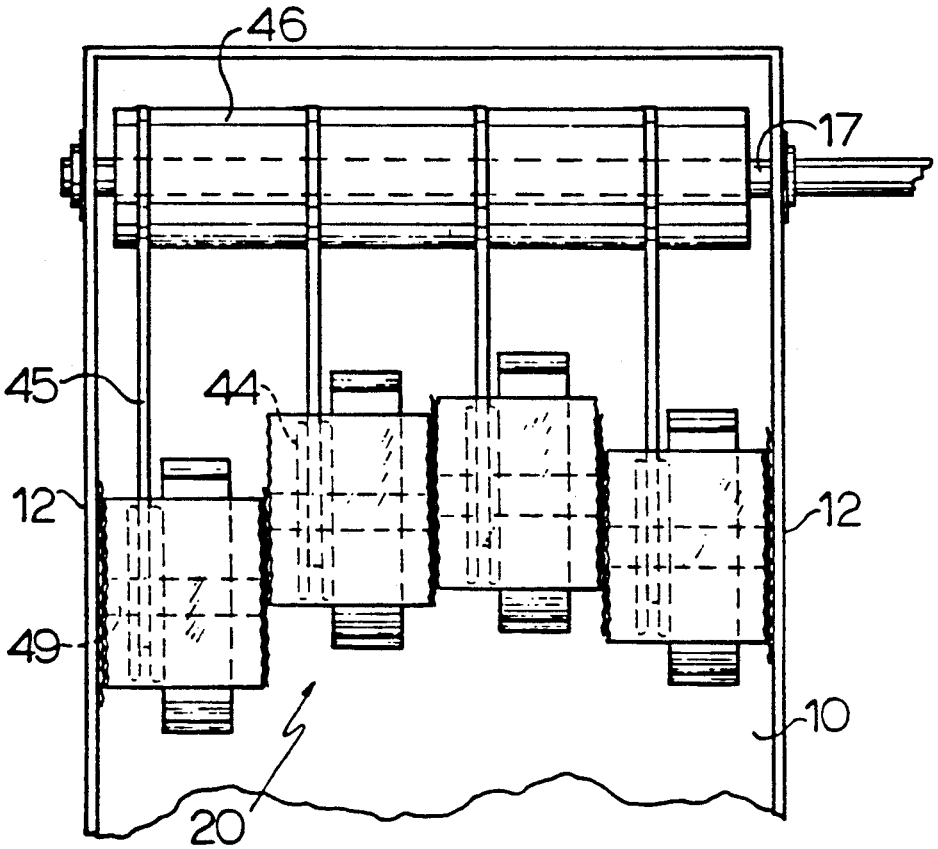
FIG. 6 is a schematic top plan view of an alternative embodiment with the cover removed for clarity.
Figure 6A:
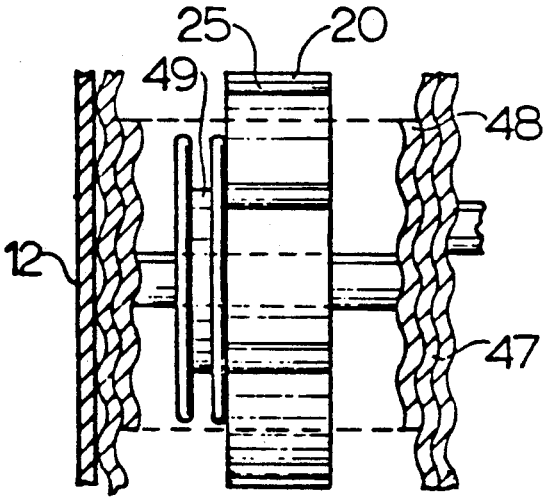
FIG. 6A is an enlarged fragmentary view showing the longitudinal adjustment means.

FIG. 6 shows an alternative embodiment and, where parts are similar, the same reference characters have been used.

It is similar in construction to the embodiment previously disclosed with the exception that the drive means is different and additional means are provided to adjust the position of the fingernail contacting stimulator means collectively designated 20.

Figure 8:
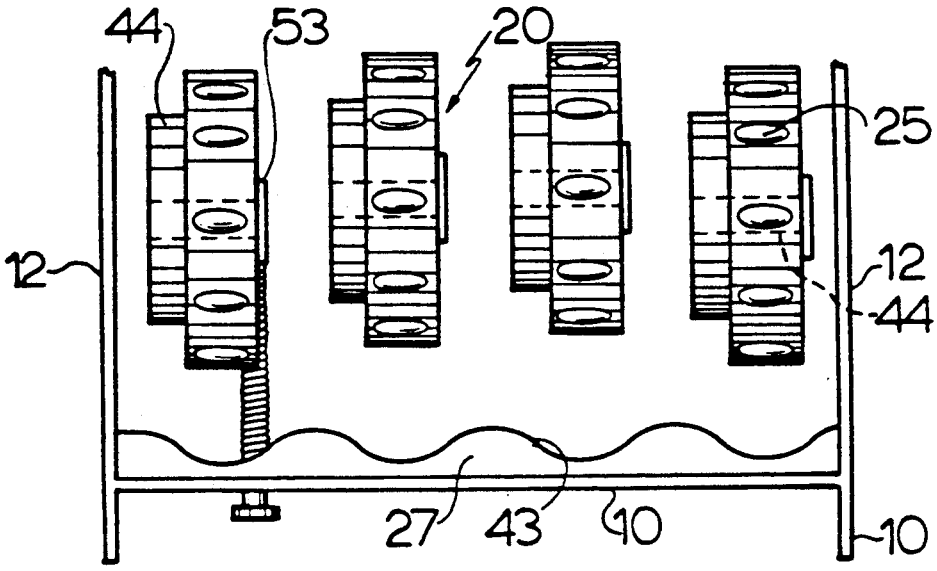
FIG. 8 is a partially schematic end elevation of FIG. 7.

In this embodiment, the finger beds (not illustrated) are similar to those shown in FIG. 8 and consist of arcuately curved concavities 43 which extend longitudinally under each of the stimulators wheels 20 so that the four fingers rest comfortably within these concavities.

For this reason it is necessary to raise or lower the individual stimulator wheel assemblies 20 relative to the fingernails of the user. In FIG. 6, the assemblies 20 are provided with coaxially situated belt pulleys 44 secured to one side of each of the wheels 20 and a belt 45 extends around these pulleys and around a longitudinally extending one piece pulley 46 secured to driveshaft 17 which is operatively connected to the source of power shown schematically at 16 in FIG. 1.

One method of adjustment of the assemblies 20 as shown, it being understood that they pivot in a vertical arc around the longitudinal axis of shaft 17. This shows vertically fixed dividers 47 extending upwardly from the base and having vertical corrugations 48 on each side thereof. The individual axles o spindles 49 of the assemblies 20 are mounted within inverted U-shaped frames 50, the outer sides of the legs of which are also corrugated to engage the corrugations 48 so that they can be slid upwardly or downwardly and locked in the desired position by means of set screws 51.

This embodiment allows the hand to lay flat in a more comfortable position with each fingernail contacting stimulator wheel assembly being adjusted as desired.

Figure 6B:
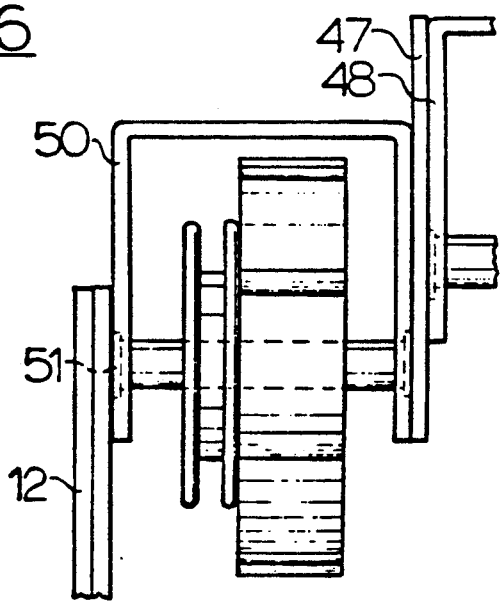
FIG. 6B is a fragmentary end elevation showing the vertical adjustment of the individual wheels.

FIG. 6B is a fragmentary end elevation showing the vertical adjustment of the individual wheels.

Figure 7:
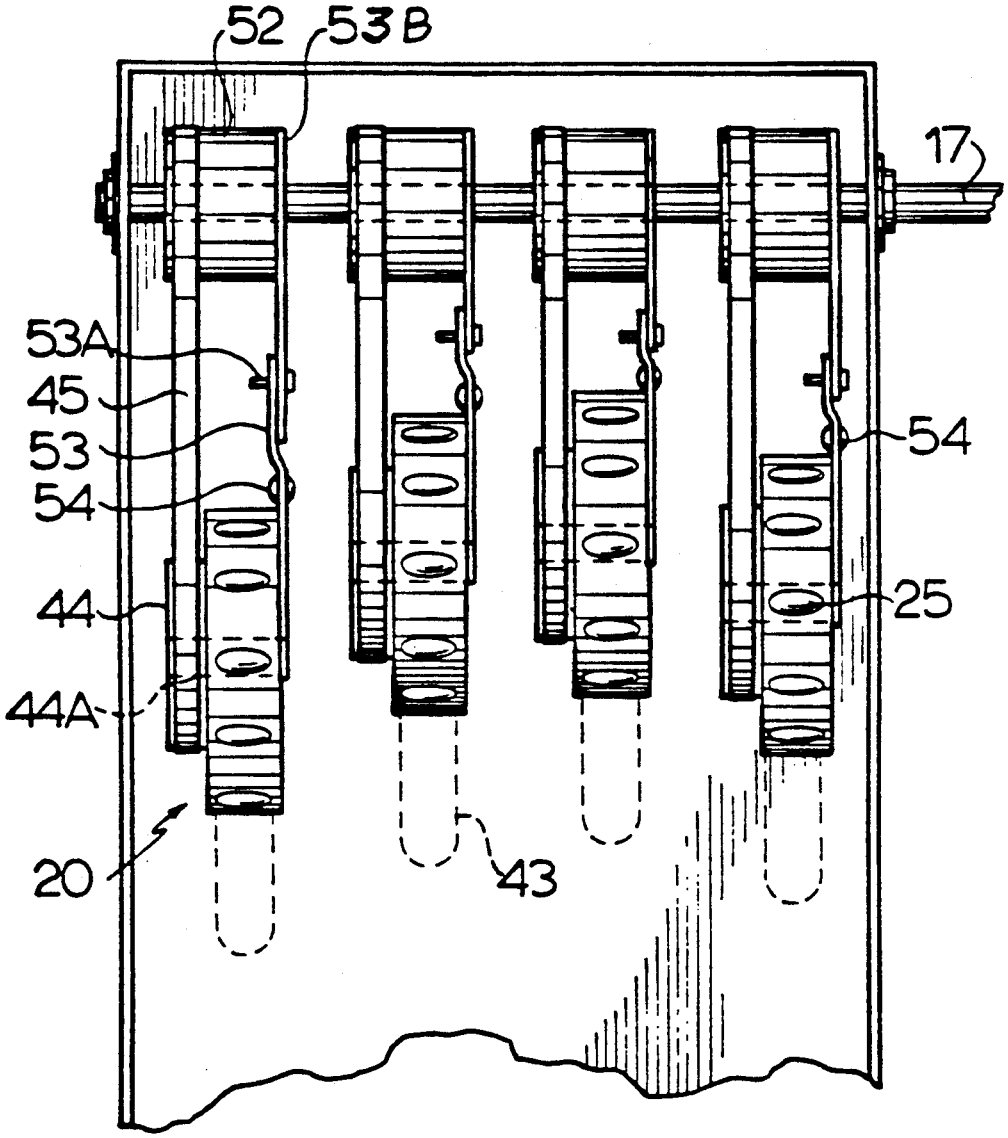
FIG. 7 is a partially schematic top plan view of a still further embodiment with the cover removed for clarity.
Figure 9:
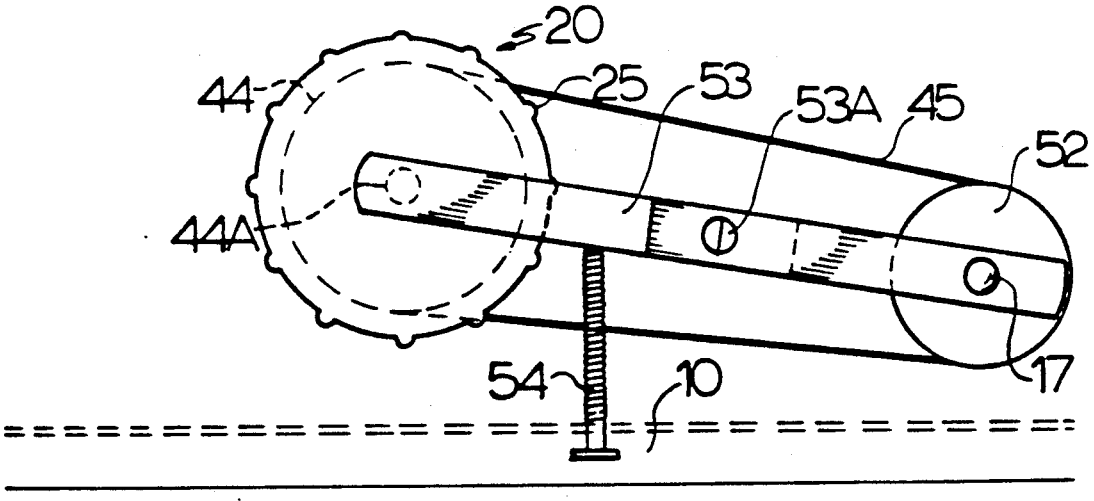
FIG. 9 is schematic side elevation of one element of a still further embodiment.

FIGS. 7, 8 and 9 show an embodiment in which the longitudinal positioning of the individual assemblies 20 may be adjusted as well as the height of the assemblies above the fingernails which are situated underneath in a manner similar to that described in FIG. 6.

In this embodiment individual pulleys 52 are secured to the driveshaft 17 and the assemblies 20 are each mounted upon shafts or pins 44A secured by one end thereof to one end of a longitudinally extending strap 53 which pivots upon the driveshaft 17 by the other end 53B thereof. These straps are adjustable lengthwise by means of set screw 53A engaging within closed ended slots (not illustrated) in the intermediate portions of the strap with drive belts 45 engaging around pulleys 52 and corresponding pulleys 44 secured to the sides of the assemblies 20 as described in FIG. 6.

Figure 10:
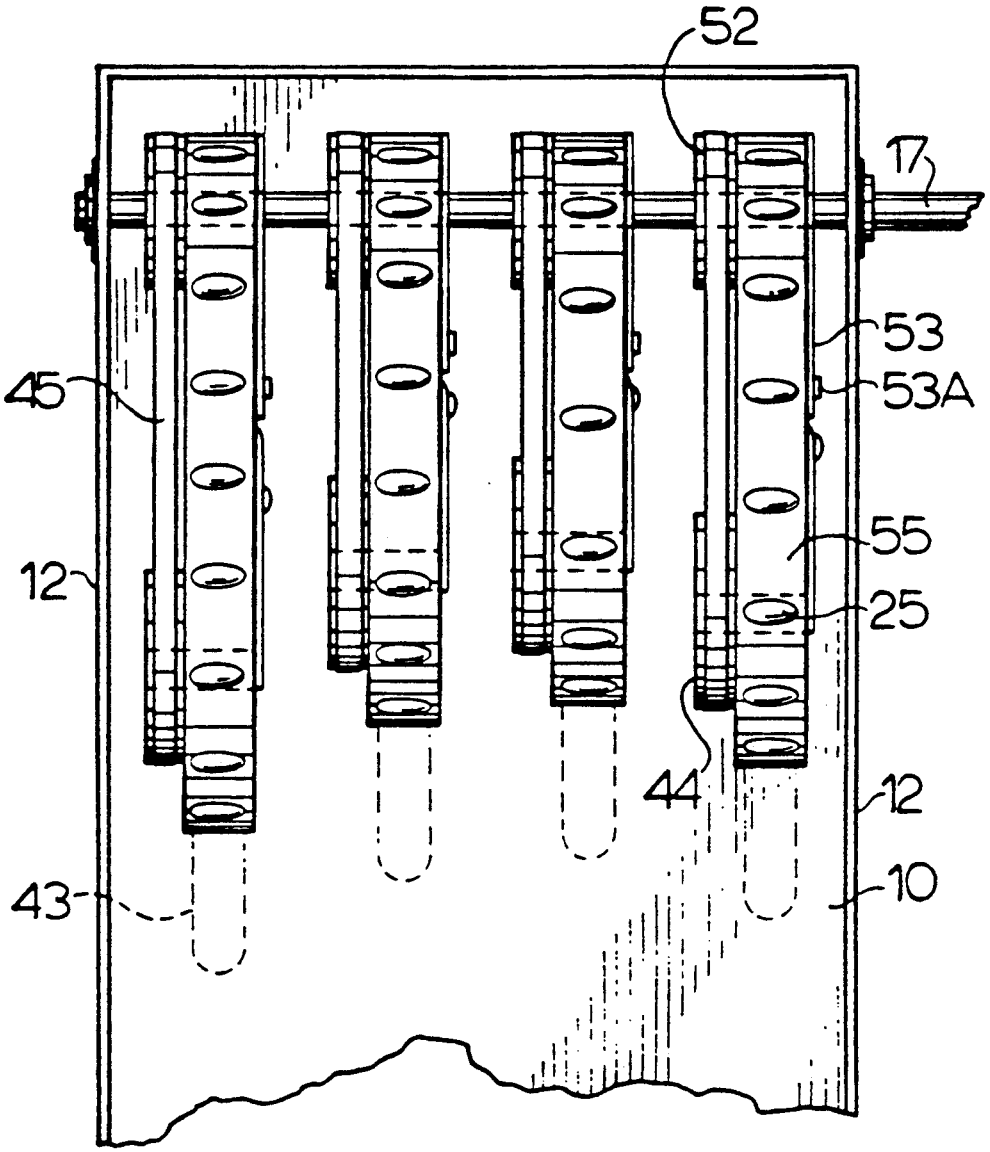
FIG. 10 is a partially schematic top plan view of a further embodiment of the embodiment shown in FIG. 7 with the cover removed for clarity.

Horizontal adjustment is by means of a vertically situated adjustment screw 54 extending upwardly from the base 10 and engaging the underside of the straps 53 as shown in FIGS. 9 and 10.

Lengthwise adjustment is of course limited because of the belts 45 but vertical adjustment pivoting around the axis of shaft 17 provides accurate space relationship between the fingernails of the user and the underside peripheral portions of the wheels 20.

Once again grooves 43 are formed within the finger supporting portion of the base as shown in phantom in FIG. 7 and also shown in FIG. 8.

FIG. 10 is an embodiment similar to that shown in FIGS. 7, 8 and 9 with the exception that the fingernail contacting stimulator means takes the form of an endless belt 55 extending around the drive pulleys 52 and the stimulator wheel pulleys 44 and having the molded raised portions 25 formed upon the outer surface thereof in substantially equidistant spaced relationship around the periphery as clearly shown. These may either be used as the drive belt or separate drive belts 45 may be provided as desired.

Figure 11:
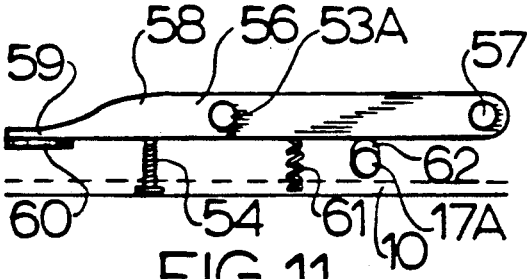
FIG. 11 is a side elevation of one of the elements of a still further embodiment.
Figure 13:
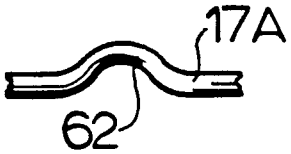
FIG. 13 is a fragmentary side elevation of the drive shaft of the embodiment shown in FIGS. 11 and 12.
Figure 12:
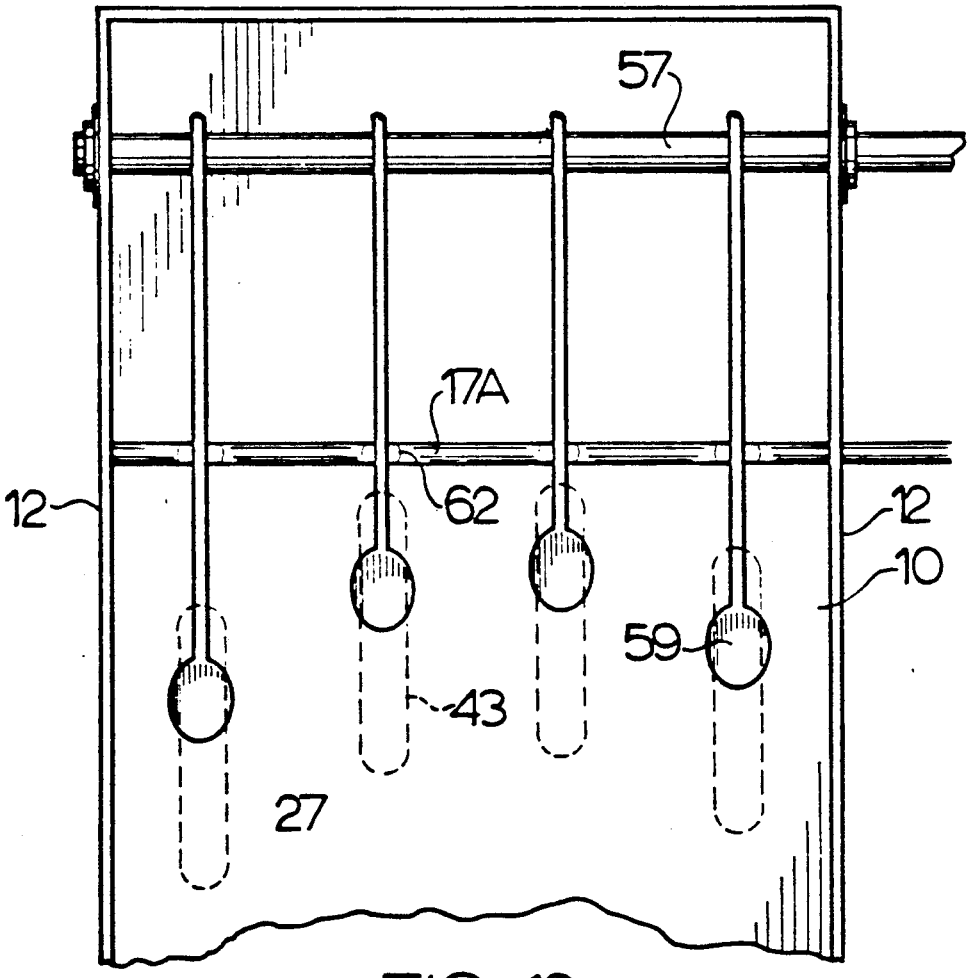
FIG. 12 is a schematic top plan view of the embodiment shown in FIG. 11 with the cover removed.

Reference next should be made to FIGS. 11, 12 and 13 in which the fingernail contacting stimulator means takes the form of an individual arm 56 for each fingernail pivoted upon a stationary shaft or spindle 57 spanning the sides 12 of the casing and above the base 10. The length of the shafts are varied to engage the nails of the four fingers situated upon the bed 27 and within the finger engaging grooves 43 shown in FIG. 8.

The free ends 58 of the arms 56 are spatulate as shown by reference character 59 and are provided with a resilient pad 60 on the underside thereof.

These arms pivot around the axis of spindle 57 and the lowermost position may be adjusted by means of a vertically situated set screw 54 operating in a manner similar to that hereinbefore described.

The arms 56 may be adjustable lengthwise as described in FIGS. 7, 8 and 9 and a tension spring 61 extends between the arms 56 and the base 10 and normally maintains the arms upon the height adjusting screw 54.

The driveshaft 17A in this embodiment is operatively connected to the source of power and rotates, being situated on the underside of arms 56 and adjacent the rear pivot support 57 thereof. Cams are provided along the length of the driveshaft by forming slight bends 62 therealong as shown in FIG. 13 and these may be at the same radial position along the shaft or may be spaced radially apart as desired.

In operation, with the shaft 17A rotating, the arms move upwardly and downwardly engaging the fingernails with a tapping motion once again giving the necessary stimulation.

In all of the other embodiments, once the necessary adjustments have been made to position the fingers and nails in relation to the fingernail engaging stimulator assemblies, a source of power rotates the stimulator wheels with the resilient projections striking the nails rapidly thus giving the necessary stimulation which is equivalent to the normal buffing action often used but without the effort required.

Figure 14:
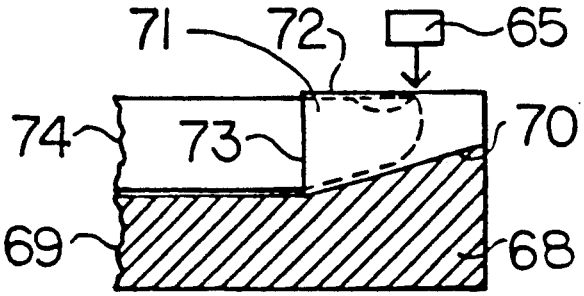
FIG. 14 is a fragmentary schematic side elevation of a still further embodiment.

Finally, reference should be made to FIG. 14 which shows in schematic form, a still further embodiment to apply the stimulating vibrational effect to the fingernails.

It consists of a bed 68 made of a nonconductor material such as rubber or plastic having a horizontal surface 69 and then upwardly and forwardly sloping surface 69 and a shroud type enclosure 61 made sloping surface 70 and a shroud type enclosure 71 made from an electrical conducting material and situated over the sloped surface 70 and having a horizontal upper surface 72 thus defining a tapered pocket with the wide open end 73 allowing the insertion of the finger as shown in phantom by reference character 74. As the fingertip is inserted with the nail uppermost, the nail is forced into contact with the underside of the horizontal surface 72. It should be understood that although only one such pocket is shown, nevertheless the block 68 should be wide enough to receive all four fingertips with a shroud 71 for each.

A source of electrical power indicated schematically by reference character 65 is operatively connected to the shrouds 71 with the appropriate electric hook-up and controls from 9-volt batteries or equivalent DC current source. This may supply electrical energy to the shrouds either directly or in the form of high frequency vibration either of which will stimulate the nails with the necessary adjustments being provided for controlling same.

A further embodiment may be used in which the size and power of motor 16 is such that it no longer requires the assistance of gears. This would eliminate the necessity for the drive shaft 17, gears 22 and corresponding gears 23. Shaft 19 would become the common drive shaft with stimulator wheels 20 fixed to it. The R.P.M. of each stimulator wheel 20 would now be the same requiring an equal number of raised portions 25 to be spaced evenly on the surface of each stimulator wheel 20.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A reflexology stimulating device for fingernails comprising a base, a plurality of finger supporting means on said base for supporting respective fingers thereon, individual non-abrasive fingernail contacting stimulator means for each finger, means mounting the stimulator means in positions confronting and spaced from the respective finger supporting means, and stimulator actuating means for periodically moving the fingernail contacting stimulator means towards and away from the respective finger supporting means thereby to make periodic contact with the fingernails of the fingers supported by said supporting means.

2. The device according to claim 1 in which said finger supporting means includes individual means a ring finger, and a little finger of a user's hand in proximity with said fingernail contacting stimulator means.

3. The device according to claim 2 in which said finger support means each includes a finger receiving bed for each of said fingers, engageable by a distal end of the respective one of said fingers and means to adjust each bed vertically relative to the respective fingernail contacting stimulator means.

4. The device according to claim 2 which includes means to adjust said individual fingernail support means relative to the corresponding fingernail contacting stimulator means.

5. The device according to claim 1 which includes drive means operatively connected to said fingernail contacting stimulator means, said drive means including a common drive shaft, journalled for rotation upon said base and an individual drive means operatively connecting said drive shaft to each of said fingernail contacting stimulator means.

6. The device according to claim 5 in which said finger support means each includes a finger receiving bed for each of said fingers, engageable by distal ends of said fingers and means to adjust each bed vertically relative to the respective fingernail contacting stimulator means.

7. The device according to claim 5 in which said each fingernail contacting stimulator means includes a resilient peripheral surface and a plurality of peripheral surface thereof.

8. The device according to claim 7 in which said fingernail contacting stimulator means includes a spindle supported upon said base, and a wheel journalled for rotation upon said spindle.

9. The device according to claim 5 in which each of the individual fingernail contacting stimulator means includes a longitudinally extending strap pivoted to said base by one end thereof for vertical movement of the other end in an arc, the strap having an underside, a respective fingernail contacting stimulator on the underside of respective said strap, said drive shaft including cams thereon, one for each strap and operatively connecting the underside of each strap for vertical reciprocation of said other end thereof and tension spring means operatively extending between said strap with said drive shaft.

10. The device according to claim 9 in which each individual fingernail contacting stimulator means is situated at a height above a respective finger supporting means and including adjustment means to control the height of said individual fingernail finger supporting means, said adjustment means including vertically situated adjusting screws operatively extending between said base and respective ones of longitudinally extending straps, each said strap pivoting around said common drive shaft when adjusted.

11. The device according to claim 1 in which said finger support means includes individual finger support blocks for each finger support upon said base and means to adjust each finger support block longitudinally relative to the corresponding fingernail contacting stimulator means.

12. The device according to claim 11 which includes means to adjust each finger support block vertically relative to the corresponding fingernail contacting stimulator means.

13. The device according to claim 1 in which the fingernail contacting stimulating means includes a fingertip rest for each finger and having an inclined upwardly and forwardly extending surface, a shroud over said fingertip rest having an open end and having a horizontal upper surface, said horizontal upper surface and said upwardly and forwardly extending surface defining a tapered pocket whereby the fingernail of a finger inserted into said pocket contacts said shroud from below and electrical stimulation means operatively connected to said shroud.

14. A reflexology stimulating device for fingernails comprising a base, a plurality of finger supporting means on said base for supporting respective fingers thereon, said finger supporting means including individual means for supporting an index finger, a middle finger, a ring finger, and a little finger of user's hand in proximity with said fingernail contacting stimulator means, said individual means being adjustable horizontally and vertically relative to said fingernail contacting stimulator means, individual non-abrasive fingernail contacting stimulator means for each finger, means mounting the stimulator means in positions confronting and spaced from the respective finger supporting means, and stimulator actuating means for moving the fingernail contacting stimulator means into periodic contact with the fingernails of the fingers supported by said supporting means.

15. The device according to claim 14 in which said finger support means each includes a finger receiving bed for each of said fingers, engageable by distal ends of said fingers and means to adjust each bed vertically relative to the respective fingernail contacting stimulator means.

16. The device according to claim 4 in which said means to adjust each finger supporting means vertically includes a horizontal corrugated divider between adjacent blocks and corresponding horizontal corrugations on each block selectively engageable with the corresponding corrugations of adjacent ones of the dividers.

17. A reflexology stimulation device for fingernails comprising a base, a plurality of finger supporting means on said base for supporting respective fingers thereon, individual non-abrasive fingernail contacting stimulator means for each finger, each including a resilient peripheral surface and a plurality of raised portions substantially equidistantly spaced around the peripheral surface, means mounting the stimulator means in positions confronting and spaced from the respective finger supporting means, and stimulator actuating means for moving the finger contacting stimulator means into periodic contact with the fingernails of the fingers supported by said supporting means, said actuating means comprising drive means operatively connected to said fingernail contacting ; stimulator means, said drive means including a common drive shaft, journalled for rotation upon said base, a spindle supported upon said base, drive pulley means on said common drive shaft, a common shaft supported upon said base for said fingernail contacting stimulator means and an individual driven pulley on said common shaft for each of said fingernail contacting stimulator means and belt means extending around said drive pulley means and each said driven pulley.

18. The device according to claim 17 which includes means to adjust individual fingernail contacting stimulator means horizontally relative to said finger support means, said means to adjust individual fingernail contacting stimulator means including stationary vertical corrugated dividers between adjacent fingernail contacting stimulator means and corresponding vertical corrugations on said fingernail contacting stimulator means, interlocking with said dividers and being positionable there along.

19. The device according to claim 18 which includes means to adjust said individual fingernail support means relative to the corresponding fingernail contacting stimulator means.

20. A method of stimulation for fingernails consisting of supporting fingers carrying the fingernails, engaging the fingernails with a relatively fast moving resilient surface having projections formed in substantially equidistantly spaced apart relationship upon the said resilient surface thereby to press intermittently on the fingernails and adjusting relative vertical and horizontal positions of the fingernails and said resilient surface.

* * * * *